United States Patent [19]

Bell

[11] 4,055,008

[45] Oct. 25, 1977

[54] ACCOUNT AND FILE BOOK

[75] Inventor: Heather Bell, Englewood, N.J.

[73] Assignee: The Raymond Lee Organization, Inc., New York, N.Y. ; a part interest

[21] Appl. No.: 662,114

[22] Filed: Feb. 27, 1976

[51] Int. Cl.[2] ..... G09F 7/00

[52] U.S. Cl. ..... 40/104.19; 281/31

[58] Field of Search ..... 281/30, 31; 283/57; 40/104.19

[56] References Cited

U.S. PATENT DOCUMENTS

| | | | |
|---|---|---|---|
| 577,998 | 3/1897 | Wolsieffer | 40/104.19 |
| 672,723 | 4/1901 | Vernon | 281/30 |
| 1,023,466 | 4/1912 | Gareis | 281/31 |
| 1,484,827 | 2/1924 | Heend | 40/104.19 |
| 1,694,632 | 12/1928 | Wade | 40/104.19 |
| 2,382,476 | 8/1945 | Glasoe | 281/31 |
| 3,267,841 | 8/1966 | Metcalf | 281/31 X |
| 3,806,163 | 4/1974 | Mercure | 40/104.19 X |

*Primary Examiner*—Louis G. Mancene
*Assistant Examiner*—Wenceslao J. Contreras
*Attorney, Agent, or Firm*—Daniel Jay Tick

[57] ABSTRACT

Each of a plurality of pages bound together to form a book has a plurality of open pockets for removably storing paper items. Front and back covers are affixed to the pages. The front cover has a pocket thereon for removably storing a writing implement.

1 Claim, 3 Drawing Figures

ACCOUNT AND FILE BOOK

DESCRIPTION OF THE INVENTION

The present invention relates to an account and file book.

Objects of the invention are to provide an account and file book of simple structure, which is inexpensive in manufacture, handy and convenient in use, and functions efficiently, effectively and reliably to store any desired paper items such as, for example, bills, checks, notes, and the like, with ready and rapid accessibility.

In order that the invention may be readily carried into effect, it will now be disclosed with reference to the accompanying drawing, wherein.

Figure 1:
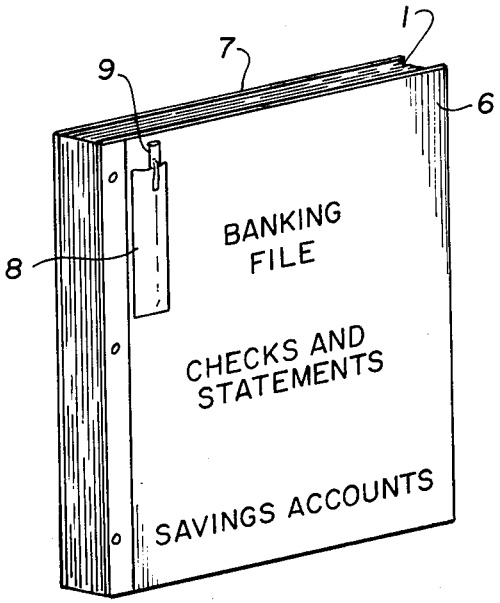
FIG. 1 is a perspective view of an embodiment of the account and file book of the invention, in closed condition.
Figure 2:
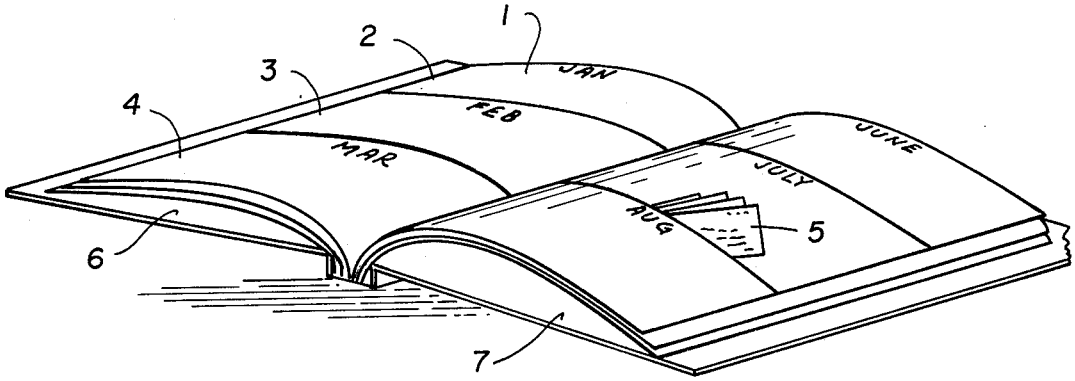
FIG. 2 is a perspective view of the embodiment of FIG. 1 of the account and file book of the invention, in open condition.

The account and file book of the invention comprises a plurality of pages 1, and so on (FIGS. 1 and 2), bound together to form a book. Each of the pages has a plurality of open pockets 2, 3, and 4 (FIG. 2) for removably storing paper items such as, for example, bills, notes, checks 5 (FIG. 2), and the like.

The pages and pockets thereof have writing areas thereon and are headed or labeled as desired, so that they are utilized for keeping financial accounts, and the like.

Front and back covers 6 and 7, respectively, are affixed to the pages 1, and so on. The front cover 6 has a pocket 8 thereon for removably storing a writing implement 9 such as for example, a pencil, pen, or the like.

Figure 3:
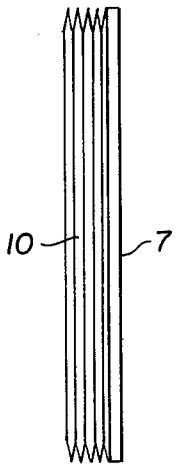
FIG. 3 is an edge view of the back cover of the embodiment of FIGS. 1 and 2.

An accordion pleated pocket 10 is affixed to the inside of the back cover, as shown in FIG. 3. The pocket 10 is used to store larger papers in greater numbers than the pockets 2, 3, 4, and so on.

The account and file book of the invention is also ideal for office use. This includes orders paid and unpaid, invoices paid and unpaid, and checks or any thing else pertinent to office operation. The book may come in any size, as desired or needed.

While the invention has been described by means of a specific example and in a specific embodiment, I do not wish to be limited thereto, for obvious modifications will occur to those skilled in the art without departing from the spirit and scope of the invention.

I claim:

1. An account and file book, comprising a plurality of pages bound together to form a book, each of the pages having a plurality of non-overlapping open pockets for removably storing paper items, the pages and pockets having writing areas thereon for desired designations;

front and back covers affixed to the pages, the front cover having an open pocket on the outside surface thereof for removably storing a writing implement; and an accordion pleated pocket affixed to the inside surface of the back cover for storing larger paper than the pockets of the pages in greater numbers than said pockets, said accordion pleated pocket opening in the same direction as the pages and covers of the book.

* * * * *